US007857895B2

(12) United States Patent
Kawano et al.

(10) Patent No.: US 7,857,895 B2
(45) Date of Patent: Dec. 28, 2010

(54) MOISTURE SEPARATION HEATER

(75) Inventors: Shunji Kawano, Yokohama (JP); Koichi Yoshimura, Yokohama (JP); Takafumi Kamada, Yokohama (JP); Tatsuya Okihara, Yokohama (JP); Hiroshi Yamaguchi, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 375 days.

(21) Appl. No.: 12/063,953

(22) PCT Filed: Aug. 18, 2005

(86) PCT No.: PCT/JP2005/015077

§ 371 (c)(1),
(2), (4) Date: Feb. 15, 2008

(87) PCT Pub. No.: WO2007/020695

PCT Pub. Date: Feb. 22, 2007

(65) Prior Publication Data

US 2009/0126574 A1 May 21, 2009

(51) Int. Cl.
*B01D 50/00* (2006.01)

(52) U.S. Cl. ..... 96/113; 96/126; 122/34; 122/483

(58) Field of Classification Search ..... 96/113, 96/174, 189, 126; 122/34, 483
See application file for complete search history.

(56) References Cited

U.S. PATENT DOCUMENTS 3,667,430 A 6/1972 Hubble et al.

FOREIGN PATENT DOCUMENTS

| | | |
|---|---|---|
| CN | 2384188 Y | 6/2000 |
| JP | 58-6305 A | 1/1983 |
| JP | 58-6391 A | 1/1983 |
| JP | 60-11004 A | 1/1985 |

(Continued)

OTHER PUBLICATIONS

Translation of JP 60-11004 A (Toshiba Corp.), Jan. 21, 1985.*

(Continued)

*Primary Examiner*—Duane Smith
*Assistant Examiner*—Christopher P Jones
(74) *Attorney, Agent, or Firm*—Foley & Lardner LLP

(57) ABSTRACT

A hygroscopic moisture separating and heating apparatus (20) comprises a main body container (1) having a cylindrical shape, a partition plate (5) provided to define a space together with an inner circumferential face of the main body container (1) and configured to divide the internal space of the main body container (1) into a lower temperature area (30) and a higher temperature area (31), a steam inlet (6) provided to the lower temperature area (30) of the main body container (1), a steam outlet (7) provided to the higher temperature area (31) of the main body container (1), a hygroscopic moisture separator (8) located in the lower temperature area (30) of the main body container (1), and a U-shaped pipe (2) through which heated steam for heating the steam to be heated is fed. The U-shaped pipe includes an advancing part (21), a retracting part (22), and a U-shaped part (23) connecting the advancing part (21) with the retracting part (22). Either of the advancing part (21) and the retracting part (22) of the U-shaped pipe (2) extends through the partition plate across the lower temperature area (30) and the higher temperature area (31).

8 Claims, 5 Drawing Sheets

FOREIGN PATENT DOCUMENTS

| | | | |
|---|---|---|---|
| JP | 2-242001 | A | 9/1990 |
| JP | 3-134491 | A | 6/1991 |
| JP | 2677661 | B2 | 7/1997 |
| JP | 9-329302 | A | 12/1997 |
| JP | 2000-64622 | A | 2/2000 |
| JP | 2005-233565 | A | 9/2005 |

OTHER PUBLICATIONS

Translation of JP 58-6391 A (Hitachi, Ltd.), Jan. 13, 1983.*
Translation of JP 2-242001 A (Toshiba Corp.), Sep. 26, 1990.*

* cited by examiner

MOISTURE SEPARATION HEATER

FIELD OF THE INVENTION

The present invention relates to a hygroscopic moisture separating and heating apparatus adapted to remove hygroscopic moisture from steam with higher humidity and heat the steam by using heated steam.

BACKGROUND ART

Generally, in an atomic power plant, steam having finished its task in a high pressure turbine contains approximately 12% hygroscopic moisture. The hygroscopic moisture is typically present in a state of water drops contained in the steam or water adhered to wall surfaces of the apparatus and piping.

When the hydroscopic moisture content in the steam is considerably increased, the hygroscopic moisture may tend to frequently collide with wall surfaces of apparatuses, such as a turbine blade installed in the turbine, thus causing erosion that may leads to serious damage of the equipment. In a low pressure turbine, the turbine efficiency becomes higher as the humidity of the steam fed to the low pressure turbine is greater.

To solve this problem, a hygroscopic moisture separating and heating apparatus for separating the hygroscopic moisture from steam and heating the steam has been provided between the high pressure turbine and the low pressure turbine, in order to remove the hygroscopic moisture from the steam fed from the high pressure turbine, heat the removed steam, and feed the so-heated higher temperature steam into the low pressure turbine. As the hygroscopic moisture separating and heating apparatus of this type, examples of the construction are described in, for example, JP2-242001A and JP9-329302A.

A conventional hygroscopic moisture separating and heating apparatus is now described with reference to FIGS. 9 and 10. FIG. 9 is a lateral cross section showing a construction of the conventional hygroscopic moisture separating and heating apparatus 70, and FIG. 10 is a longitudinal cross section of the hygroscopic moisture separating and heating apparatus taken along line E-E of FIG. 9.

As shown in FIGS. 9 and 10, the hygroscopic moisture separating and heating apparatus 70 includes a main body container 51 having a lateral and cylindrical shape, a hygroscopic moisture separator 58 incorporated in the main body container 51 and adapted to remove hygroscopic moisture from steam 85 to be heated, and U-shaped pipes 52 each located above the hygroscopic moisture separator 58 and adapted to heat the steam 85 to be heated.

In such a construction, the hygroscopic moisture separating and heating apparatus 70 is located to be symmetrical about an imaginary central plane F-F defined at the longitudinal center of the main body container 51.

Through each U-shaped pipe 52, heated steam 86 for heating the steam 85 to be heated is fed. As the heated steam 86, extraction steam supplied from the high pressure turbine of the atomic power plant or main steam supplied from a nuclear reactor can be mentioned.

Each U-shaped pipe 52 includes an advancing part 521, a retracting part 522 located below the advancing part 521, and a U-shaped part 523 connecting the advancing part 521 with the retracting part 522. Each U-shaped pipe 52 is attached to a header 53 so as to constitute each pipe bundle 54, wherein the header 53 is located outside the main body container 51 and adapted to supply and discharge the heated steam 86.

Below the main body container 51, for example, three hygroscopic moisture separators 58 are located along the longitudinal direction.

Steam inlets 56, though which the steam 85 to be heated is fed into the main body container 51, are provided at a bottom portion of the container 51, and steam outlets 57, through which the steam 85 to be heated is discharged from the main body container 51, are provided at a top portion of the container 51.

The steam 85 to be heated, which was fed from the high pressure turbine and supplied into the main body container 51 via each steam inlet 56, passes through each hygroscopic moisture separator 58, so that the hygroscopic moisture can be removed from the steam 85. Thereafter, the steam 85 to be heated is flowed in the main body container 51 upward orthogonally to the advancing part 521 and the retracting part 522 of the U-shaped pipe 52. Consequently, the steam 85 to be heated can be heated due to the heating steam 86 flowed through the U-shape pipe 52, and is then discharged from the main body container 51 via each steam outlet 57. Chain line arrows, as depicted in FIG. 10, for expressing the steam 85 to be heated, respectively designate directions in which the steam 85 to be heated is flowed in the main body container 51.

In the conventional hygroscopic moisture separating and heating apparatus 70, however, the temperature of the steam 85 to be heated becomes higher as it is flowed upward. Therefore, a temperature difference should occur between the advancing part 521 and the retracting part 522 in the U-shaped pipe 52, thus causing a significantly great difference in the amount of condensation of the heated steam 86 in the U-shaped pipe 52 due to cooling.

Namely, in the retracting part 522 of the U-shaped pipe 52, the temperature of the steam 85 to be heated in contact therewith is still relatively low. Therefore, the heated steam 86 flowed in the retracting part 522 may be unduly cooled, thus causing excessively rapid condensation. On the other hand, in the advancing part 521 of the U-shaped pipe 52, the temperature of the steam 85 to be heated in contact therewith is higher, as compared with the case of the aforementioned lower retracting part 522. Thus, the degree of being cooled for the heated steam 86 flowed in the advancing part 521 is significantly lower, as such a greater amount of the steam remains uncondensed.

In such a state, the flow rate distribution of the heated steam 86 in the U-shaped pipe 52 is likely to be unstable, and a periodic temperature change may tend to occur in the U-shaped pipe 52, leading to damage of the U-shaped pipe 52 due to thermal fatigue.

To avoid this problem, a method has been employed, in which a venting pipe (not shown) for venting non-condensable steam of the heated steam 86 is connected with an inlet portion of the U-shaped pipe 52, such that about 5% of the total amount of the heated steam 86 prior to being fed into the venting pipe can be directed into the venting pipe.

However, if the amount (or venting flow rate) of the heated steam 86 to be fed into the venting pipe is considerably large, the amount of the heated steam 86 fed into the U-shaped pipe 52 is of course reduced, thus degrading the thermal efficiency of the entire hygroscopic moisture separating and heating apparatus 70. Therefore, there is a need for reducing the venting flow rate.

SUMMARY OF THE INVENTION

The present invention was made in view of such circumstances, and it is therefore an object of this invention to provide a hygroscopic moisture separating and heating apparatus, which can securely enhance the thermal efficiency, by employing such a construction that can avoid damage of the U-shaped pipe due to thermal fatigue caused by the difference in the amount of condensation in the U-shaped pipe, thereby stabilizing the flowing condition of the heated steam flowed through the U-shaped pipe even though significantly reducing the venting amount of the heated steam fed into the venting pipe.

The present invention is a hygroscopic moisture separating and heating apparatus for separating a hygroscopic moisture from a steam to be heated and heating the steam to be heated, comprising: a main body container having a cylindrical shape; a partition plate provided, in the main body container, to define a space together with an inner circumferential face of the main body container and configured to divide the internal space of the main body container into a lower temperature area and a higher temperature area; a steam inlet, which is provided to the lower temperature area of the main body container and through which steam to be heated is fed into the main body container; and a steam outlet, which is provided to the higher temperature area of the main body container and through which the steam to be heated is discharged from the main body container; a hygroscopic moisture separator located in the lower temperature area of the main body container and adapted to separate hygroscopic moisture from the steam to be heated, which is fed into the lower temperature area via the steam inlet; and a U-shaped pipe provided in the main body container and including an advancing part, a retracting part and a U-shaped part connecting the advancing part with the retracting part, such that heated steam for heating the steam to be heated is fed through the U-shaped pipe, wherein either of the advancing part and the retracting part of the U-shaped pipe extends through the partition plate across the lower temperature area and the higher temperature area.

In the hygroscopic moisture separating and heating apparatus described above, it is preferred that the partition plate is provided orthogonally to the longitudinal direction of the main body container, and that the advancing part and the retracting part of the U-shaped pipe are arranged parallel to the longitudinal direction of the main body container.

The present invention is a hygroscopic moisture separating and heating apparatus for separating a hygroscopic moisture from a steam to be heated and heating the steam to be heated, comprising: a main body container having a cylindrical shape; a first partition plate provided in the main body container orthogonally to the longitudinal direction of the main body container and configured to divide the internal space of the main body container into two or more mutually independent areas; a second partition plate provided, in the main body container, to define a space together with an inner circumferential face of the main body container and configured to extend orthogonally to the first partition plate and divide each independent area of the main body container into a lower temperature area and a higher temperature area; steam inlets each provided to each lower temperature area of the main body container, such that steam to be heated is fed into the main body container through the steam inlet; steam outlets each provided to each higher temperature area of the main body container, such that the steam to be heated is discharged from the main body container through the steam outlet; hygroscopic moisture separators each located in each lower temperature area of the main body container and adapted to separate hygroscopic moisture from the steam to be heated fed into the lower temperature area via each steam inlet; and U-shaped pipes each provided in each independent area of the main body container and including an advancing part, a retracting part and a U-shaped part connecting the advancing part with the retracting part, such that heated steam for heating the steam to be heated is fed through the U-shaped pipe, wherein the lower temperature area of one independent area is adjacent to the higher temperature area of the other independent area, and wherein either of the advancing part and the retracting part of each U-shaped pipe extends through the second partition plate across each lower temperature area and each higher temperature area.

In the hygroscopic moisture separating and heating apparatus described above, it is preferred that the hygroscopic moisture separating and heating apparatus further comprises: a venting pipe connected with an inlet portion of the U-shaped pipe and adapted for venting the heated steam; and a pressure control valve or fluid resistor provided to the venting pipe, wherein the pressure control valve or fluid resistor controls the venting flow rate of the heated steam fed into the venting pipe within the range of 0.5 to 1% of the total flow rate measured before the heated steam is vented.

In the hygroscopic moisture separating and heating apparatus described above, it is preferred that a plurality of U-shaped pipes are provided; and that each U-shaped pipe is attached to a header so as to constitute together a pipe bundle, the header being provided outside the main body container and adapted to supply and discharge the heated steam, and that the header of one pipe bundle is attached to the main body container, in a position opposed to the header of the other pipe bundle located adjacent the one pipe bundle.

In the hygroscopic moisture separating and heating apparatus described above, it is preferred that the plurality of pipe bundles are located in a plurality of independent groups connected in series with one another, and the pipe bundles in each group are connected in parallel to one another, with the number of the pipe bundles in each group being reduced as the heated steam is flowed from the upstream to the downstream, and that a drain tank is provided, which is adapted for accumulating condensed drain generated due to the heated steam cooled by the steam to be heated, in each U-shaped pipe, wherein the drain tank is connected with the header of each pipe bundle via a drain pipe.

In the hygroscopic moisture separating and heating apparatus described above, it is preferred that a part of the condensed drain fed to the drain tank via the drain pipe from each header is fed into each higher temperature area of the main body container through a drain feed pipe, so as to cool the higher temperature area.

In the hygroscopic moisture separating and heating apparatus described above, it is preferred that the pipe bundles are prepared by assembling the plurality of U-shaped pipes and headers in advance in a factory, and then attached to the main body container on a site of installing the apparatus.

According to the present invention, in the hygroscopic moisture separating and heating apparatus, by lessening the temperature difference at each portion in the U-shaped pipe, damage of the U-shaped pipe caused by thermal fatigue due to difference of the amount of condensation of heated steam flowed through the U-shaped pipe can be suppressed, thus providing a construction in which the flow of the heated steam through the U-shaped pipe will not be unstable even though significantly reducing the venting flow rate of the heated steam fed into the venting pipe, thereby enhancing the thermal efficiency.

DETAILED DESCRIPTION OF THE PREFERRED EMBODIMENT

First Embodiment

Now, a first embodiment will be described with reference to FIGS. 1 to 4.

Figure 1:
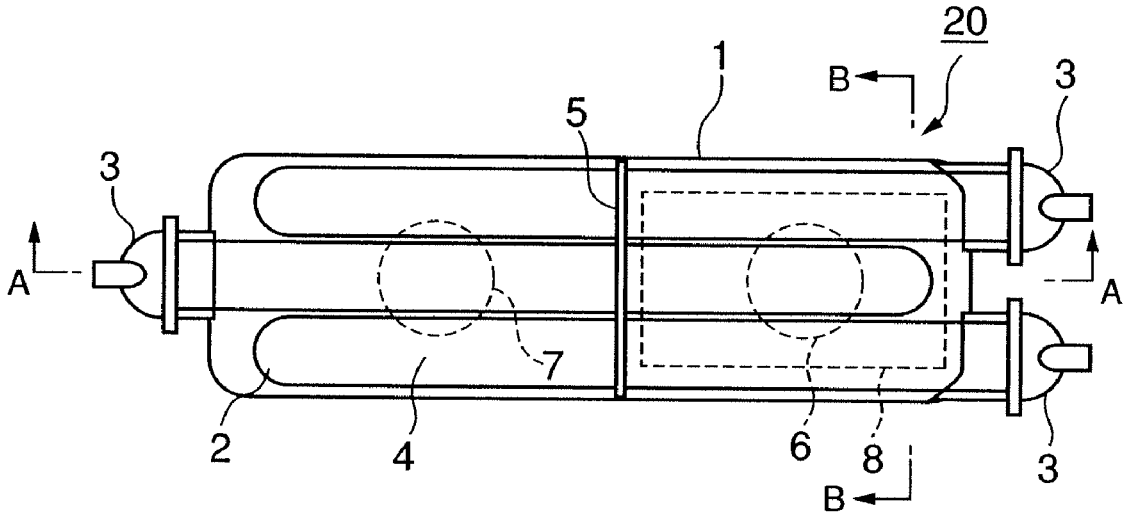
FIG. 1 is a top view showing a construction of a hygroscopic moisture separating and heating apparatus of a first embodiment when viewed from above.
Figure 2:
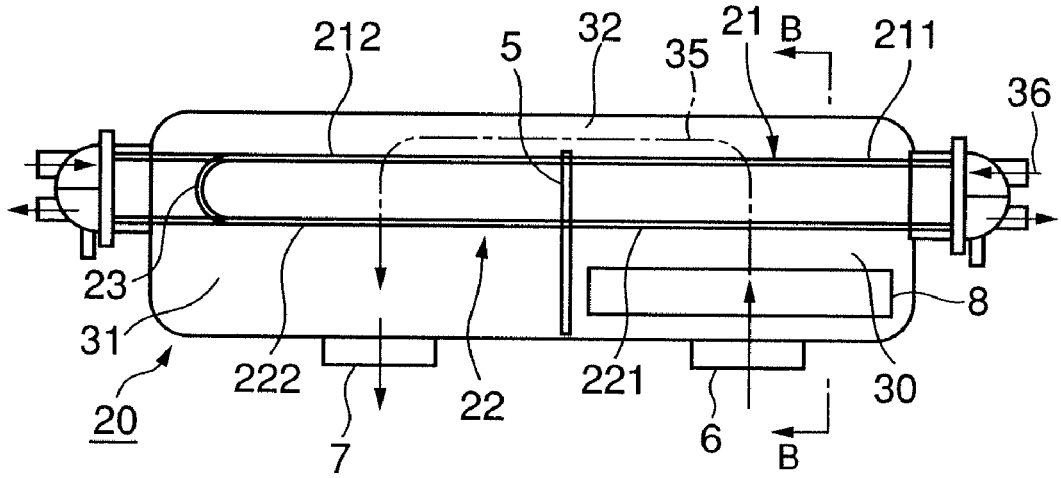
FIG. 2 is a lateral cross section of the hygroscopic moisture separating and heating apparatus taken along line A-A of FIG. 1.
Figure 3:
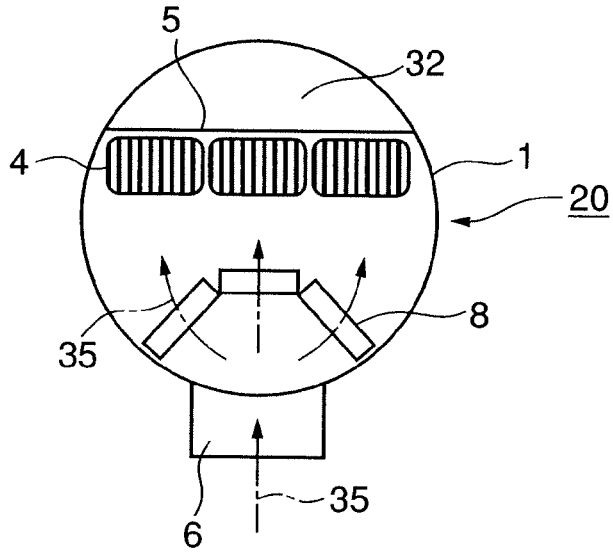
FIG. 3 is a longitudinal cross section of the hygroscopic moisture separating and heating apparatus taken along line B-B of FIG. 1.
Figure 4:
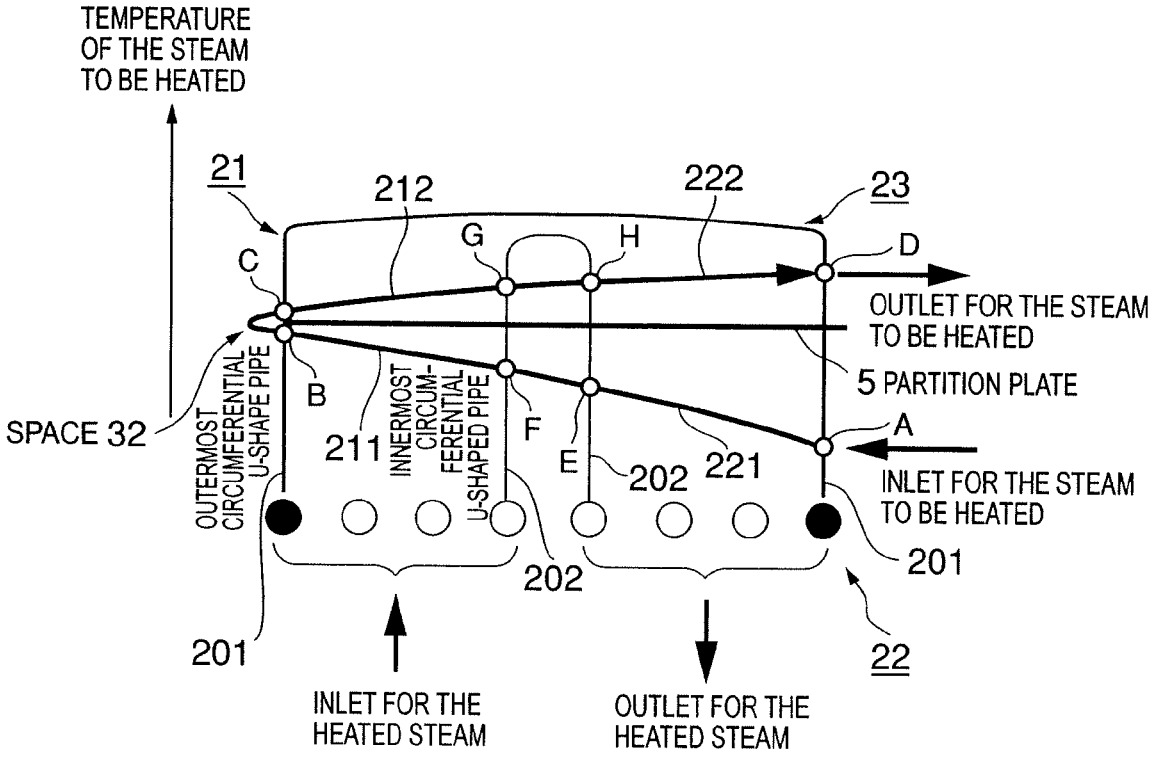
FIG. 4 is an illustration showing temperature change of steam to be heated, wherein the steam is in contact with an advancing part and a retracting part of a U-shaped pipe in a main body container of the hygroscopic moisture separating and heating apparatus of FIG. 1.

FIG. 1 is a top view showing a construction of a hygroscopic moisture separating and heating apparatus 20 of the first embodiment when viewed from above, and FIG. 2 is a lateral cross section of the hygroscopic moisture separating and heating apparatus 20 taken along line A-A of FIG. 1. FIG. 3 is a longitudinal cross section of the hygroscopic moisture separating and heating apparatus 20 taken along line B-B of FIG. 1. FIG. 4 is an illustration showing temperature change of steam 35 to be heated, wherein the steam is in contact with an advancing part 21 and a retracting part 22 of a U-shaped pipe 2 in a main body container 1.

As shown in FIGS. 1 to 3, the hygroscopic moisture separating and heating apparatus 20 includes the main body container 1 having a lateral and cylindrical shape, a partition plate 5 provided, in the main body container 1, to define a space 32 together with an inner circumferential face of a ceiling of the main body container 1 and configured to divide the internal space of the main body container 1 into a lower temperature area 30 and a higher temperature area 31, a steam inlet 6, which is provided below the lower temperature area 30 of the main body container 1 and through which the steam 35 to be heated is fed into the main body container 1, and a steam outlet 7, which is provided below the higher temperature area 31 of the main body container 1 and through which the steam 35 to be heated is discharged from the main body container 1. A hygroscopic moisture separator 8 is located in the lower temperature area 30 of the main body container 1, the separator 8 being adapted to separate hygroscopic moisture from the steam 35 to be heated, which is fed into the lower temperature area 30 from the steam inlet 6. In addition, the U-shaped pipe 2 is provided in the main body container 1. Through the U-shaped pipe 2, heated steam 36 is fed so as to heat the steam 35, which has passed through the hygroscopic moisture separator 8 and from which the hygroscopic moisture has been separated.

Chain line arrows, as depicted in FIGS. 2 and 3, for expressing the steam 35 to be heated, designate, respectively, the directions in which the steam 35 to be heated is flowed in the main body container 1.

The partition plate 5, as shown in FIGS. 1 and 2, is provided at the longitudinal center of the main body container 1, orthogonally to the longitudinal direction.

The U-shaped pipe 2 includes the advancing part 21, the retracting part 22 located below the advancing part 21, and a U-shaped part 23 connecting the advancing part 21 with the retracting part 22. The advancing part 21 and retracting part 22 of the U-shaped pipe 2 are configured to extend parallel to the longitudinal direction of the main body container 1.

The length of the advancing part 21 and retracting part 22 of the U-shaped pipe is substantially the same as the length of the main body container 1.

Either of the advancing part 21 and the retracting part 22 of the U-shape pipe 2 is configured to extend through the partition plate 5 across the lower temperature area 30 and the higher temperature area 31.

As shown in FIG. 2, the advancing part 21 include a lower temperature advancing part 211 located in the lower temperature area 30 and a higher temperature advancing part 212 located in the higher temperature area 31, while the retracting part 22 includes a lower temperature area retracting part 221 located in the lower temperature area 30 and a higher temperature area retracting part 222 located in the higher temperature area 31.

In this embodiment, a plurality of U-shaped pipes 2 are provided in the main body container 1, and each U-shaped pipe 2 is attached to a header 3 so as to constitute together a pipe bundle 4, wherein the header 3 is located outside the main body container 1 and adapted to supply and discharge the heated steam 36. For Example, the pipe bundle 4, as shown in FIG. 1, is provided in three sets, and the height of each pipe bundle 4 is substantially the same.

As shown in FIG. 1, the header 3 of one pipe bundle 4 is attached to the main body container 1 in a position opposed to the header 3 of the other adjacent bundle 4. According to the present invention, the temperature distribution along in the longitudinal direction of the main body container 1 can be uniformed as compared with the case in which all of the headers 3 of the pipe bundles 4 are provided to the main body container 1 on the same side.

A venting pipe (not shown) for venting non-condensable steam of the heated steam 36 is connected with an inlet portion of each U-shaped pipe 2, and a pressure control valve (not shown) is provided to the venting pipe.

The pressure control valve functions to control the venting flow rate of the heated steam 36 fed into the venting pipe within the range of 0.5 to 1% of the total flow rate measured before the heated steam 36 is vented.

A fluid resistor that can provide the same effect as described above may also be used in place of the pressure control valve.

In this way, the flow amount of the heated steam 36 fed to each U-shaped pipe 2 can be properly adjusted due to the provision of the venting pipe and the pressure control valve. Specifically, the adjustment of the venting flow rate of the heated steam 36 at 0.5% or greater, as compared with the total flow rate measured before the heated steam 36 is vented can prevent the flow rate of the heated steam 36 fed into each U-shaped pipe 2 from being unduly increased, thereby to avoid excessive generation of condensed drain due to excessively rapid condensation of the heated steam 36 in the U-shaped pipe 2. In addition, the adjustment of the venting flow rate of the heated steam 36 at 1% or lower, as compared with the total flow rate measured before the heated steam 36 is vented, can prevent the flow rate of the heated steam 36 to be fed into each U-shaped pipe 2 from being insufficient for the heating process, thereby suppressing degradation of the thermal efficiency of the hygroscopic moisture separating and heating apparatus 20.

Next, the operation of this embodiment constructed as described above will be discussed.

In FIG. 2, the steam 35 to be heated, which is fed in the lower temperature area 30 in the main body container 1 via the steam inlet 6, is fed upward in the lower temperature area 30, and the hygroscopic moisture is removed from the steam 35, due to the hygroscopic moisture separator 8 provided in the main body container 1.

The steam 35 to be heated, having passed through the hygroscopic moisture separator 8, is first heated by the heated steam 36 at the lower temperature area retracting part 221 of the U-shaped pipe 2, and is then heated by the heated steam 36 at the lower temperature area advancing part 211 of the U-shaped pipe 2. Subsequently, the steam 35 to be heated, having been heated in this manner in the lower temperature area 30, passes through the space 32 provided between the inner circumferential face of the ceiling of the main body container 1 and the partition plate 5. Thereafter, the steam 35 to be heated is fed downward through the higher temperature area 31, and is heated by the heated steam 36 in the higher temperature area advancing part 212 of the U-shaped pipe 2 and then further heated by the heated steam 36 in the higher temperature area retracting pipe 222 of the U-shaped pipe 2. In this way, the steam 35 to be heated, having been further heated in the higher temperature area 31, is discharged to the outside of the main body container 1 via the steam outlet 7.

As shown in FIG. 4, the temperature of the steam 35 to be heated, for which heat exchange with the heated steam 36 flowed through the U-shaped pipe 2 is performed, is the highest, when the heated steam 36 is flowed through the higher temperature area retracting part 222, and is lower than that case, when the heated steam 36 is flowed through the higher temperature area advancing part 212, further lower, when it is flowed through the lower temperature area advancing part 211, and is the lowest, when through the lower temperature area retracting part 221.

As described above, due to the division of the internal space of the main body container 1 into the lower temperature area 30 and the higher temperature area 31 by using the partition plate 5, the regions in which the steam 35 to be heated is in contact with the U-shaped pipe 2 can be more fractioned. For example, in the retracting part 22, a part, upon being at the lowest temperature, of the steam 35 to be heated contacts with the lower temperature area retracting part 221, while a part, upon being at the highest temperature, of the steam 35 to be heated contacts with the higher temperature area retracting part 222, thereby leveling the temperature of the steam 35 to be heated through the contact with the entire retracting part 22.

In this manner, the difference of average temperatures of the steam 35 to be heated, upon performing the heat exchange with the heated steam 36, can be lessened between the advancing part 21 and the retracting part 22 of the U-shaped pipe 2. Thus, the difference of the amount of condensation caused by cooling the heated steam 36 can be reduced between the advancing part 21 and the retracting part 22.

The heating process for the steam 35 to be heated in the main body container 1 will be described in more detail with reference to FIG. 4. As shown in FIG. 4, in the outermost circumferential U-shaped pipe 201 located at the outermost circumference of each pipe bundle 4, when the steam 35 to be heated is flowed in the main body container 1, the part A, upon being at the lowest temperature, of the steam 35 to be heated contacts initially with the lower temperature area retracting part 221 of the outermost circumferential U-shaped pipe 201, and then a part B, heated to an intermediate temperature, of the steam 35 contacts with the lower temperature area advancing part 211. Thereafter, a part C, heated to a further elevated temperature, of the steam 35 contacts with the higher temperature area advancing part 212 of the outermost circumferential U-shaped pipe 201, and finally the part D, upon being at the highest temperature, of the steam 35 contacts with the higher temperature area retracting part 222.

On the other hand, in an innermost circumferential U-shaped pipe 202 located at the innermost circumference of each pipe bundle 4, a part E, upon being at a sub-lowest temperature slightly higher than the lowest temperature part A, of the steam 35 to be heated contacts with the lower temperature area retracting part 221 of the innermost circumferential U-shaped pipe 202, and then a part F, heated to a sub-intermediate temperature slightly lower than the intermediate temperature part B, of the steam 35 contacts with the lower temperature area advancing part 211. Thereafter, a part G, further heated to a temperature slightly higher than the part C, of the steam 35 contacts with the higher temperature area advancing part 212 of the innermost circumferential U-shaped pipe 202, and finally a part H, upon being at a sub-highest temperature slightly lower than the highest temperature part D, of the steam 35 contacts with the higher temperature area retracting part 222.

Now, the comparison of the temperatures of the steam 35 to be heated, when it contacts with the outermost circumferential U-shaped pipe 201 and with the innermost circumferential pipe 202, will be discussed.

First, the comparison between the retracting part 22 of the outermost circumferential U-shaped pipe 201 and the retracting part 22 of the innermost circumferential U-shaped pipe 202 will be described. As shown in FIG. 4, the average of the temperatures of the lowest temperature part A and highest temperature part D of the steam 35 when it contacts with the outermost circumferential U-shaped pipe 201 and the average of the temperatures of the sub-lowest temperature part E and sub-highest temperature part H of the steam 35 when it contacts with the innermost circumferential U-shaped pipe 202 are substantially the same.

Similarly, the comparison between the advancing part 21 of the outermost circumferential U-shaped pipe 201 and the advancing part 21 of the innermost circumferential U-shaped pipe 202 reveals the fact that the average of the temperatures of the steam 35 to be heated when it contacts with the outermost circumferential U-shaped pipe 201 and the average of the temperatures of the steam 35 to be heated when it contacts with the innermost circumferential U-shaped pipe 202 are substantially the same.

Accordingly, from the comparison between the averages of the temperatures of the steam 35 to be heated when it contacts with the respective U-shaped pipes 2, it can be seen that the difference in the temperature average of the respective U-shaped pipes 2 can be lessened and equalized. As such, the difference in the amount of condensation of the heated steam 36 in the respective U-shaped pipes 2 can also be reduced.

As described above, the difference in the amount of condensation of the heated steam 36 between the advancing parts 21 and between the retracting parts 22 of each U-shaped pipe 2 provided in the main body container 1 as well as the difference in the amount of condensation of the heated steam 36 between the respective U-shaped pipes 2 can be lessened, thereby to avoid excessive generation of condensed drain due to excessively rapid condensation of the heated steam 36 in the advancing parts 21 as well as in the retracting parts 22. Thus, the venting flow rate of the heated steam 36 fed to the venting pipe can be significantly lessened.

Therefore, the flow rate of the heated steam 36 supplied into the respective U-shaped pipes 2 in order to heat the steam 35 to be heated can be increased so much, as such the thermal efficiency of the hygroscopic moisture separating and heating apparatus 20 can be securely enhanced.

In the case of assembling the hygroscopic moisture separating and heating apparatus 20, the pipe bundles 4 are prepared by assembling the plurality of U-shaped pipes 2 and headers 3 in advance in a factory, and then attached to the main body container 1 on a site of installing the hygroscopic moisture separating and heating apparatus 20.

By utilizing such an assembling method, the transport of the components to the site of installation can be facilitated, and the period of time required for the installation at the site can be reduced.

Second Embodiment

Next, a second embodiment of the present invention will be described with reference to FIGS. 5 and 6.

Figure 5:
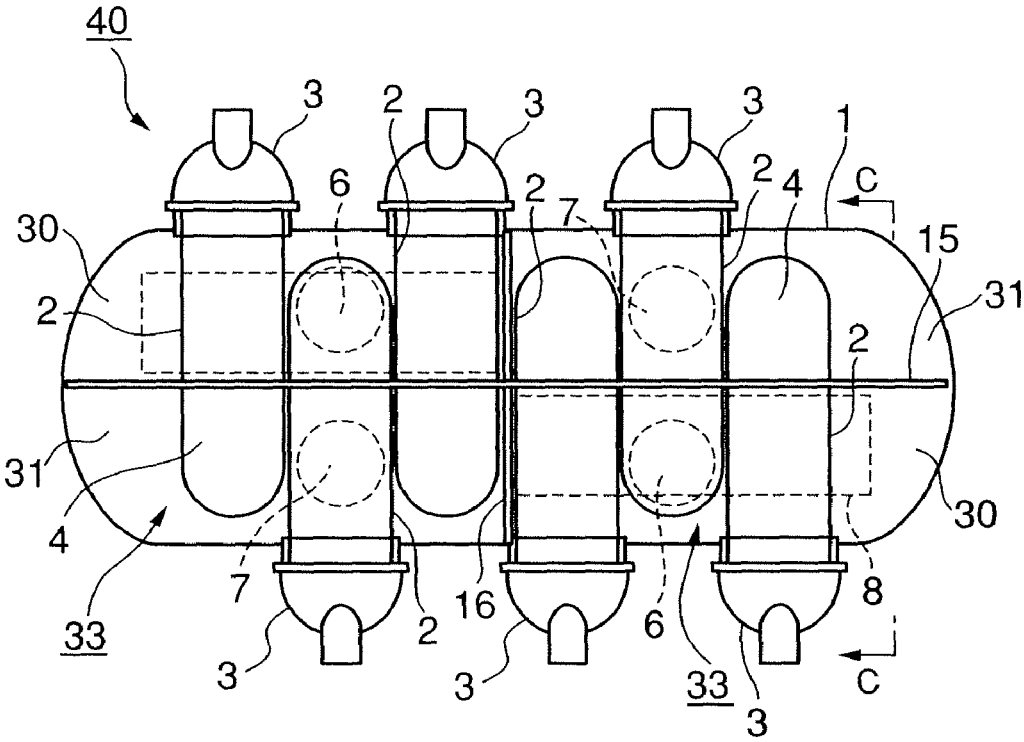
FIG. 5 is a top view showing a construction of the hygroscopic moisture separating and heating apparatus of a second embodiment when viewed from above.
Figure 6:
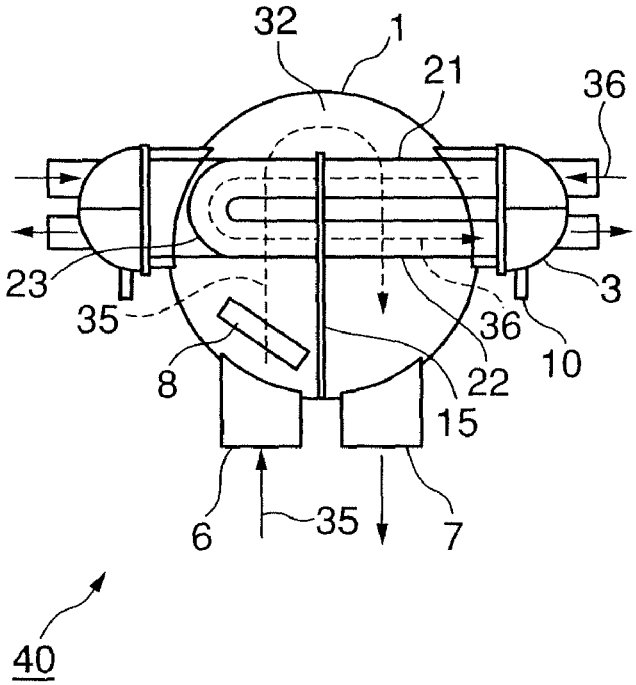
FIG. 6 is a longitudinal cross section of the hygroscopic moisture separating and heating apparatus taken along line C-C of FIG. 5.

FIG. 5 is a top view showing a construction of the hygroscopic moisture separating and heating apparatus 40 of the second embodiment when viewed from above, and FIG. 6 is a longitudinal cross section of the hygroscopic moisture separating and heating apparatus 40 taken along line C-C of FIG. 5.

As shown in FIGS. 5 and 6, the hygroscopic moisture separating and heating apparatus 40 of this embodiment includes a main body container 1 having a cylindrical shape, a first partition plate 16 provided in the main body container 1 orthogonally to the longitudinal direction of the main body container 1 and configured to divide the internal space of the main body container 1 into two or more mutually independent areas 33, and a second partition plate 15 provided, in the main body container 1, to define a space 32 together with an inner circumferential face of a ceiling of the main body container 1 and configured to extend orthogonally to the first partition plate 16 and divide each independent area 33 of the main body container 1 into a lower temperature area 30 and a higher temperature area 31. Steam inlets 6 are respectively provided below the lower temperature areas 30 of the main body container 1, through which steam 35 to be heated is fed into the main body container 1, and steam outlets 7 are respectively provided below the higher temperature areas 31 of the main body container 1, through which the steam 35 to be heated is discharged from the main body container 1. A hygroscopic moisture separator 8 is located in each lower temperature area 30 of the main body container 1, the separator 8 being adapted to separate hygroscopic moisture from the steam 35 fed into the lower temperature area 30 from each steam inlet 6. In addition, U-shaped pipes 2 are provided in each independent area 33 of the main body container 1, orthogonally to the longitudinal direction of the main body container 1. For each U-shaped pipe 2, heated steam 36 is fed so as to heat the steam 35 to be heated. The plurality of U-shaped pipes 2 and headers 3 constitute together each pipe bundle 4, and for example, six pipe bundles 4 are provided in the hygroscopic moisture separating and heating apparatus 40.

In the second embodiment shown in FIGS. 5 and 6, like parts in the first embodiment as shown in FIGS. 1 to 3 are respectively designated by like reference numerals, and will not be detailed below.

In such a hygroscopic moisture separating and heating apparatus 40, as shown in FIG. 5, the lower temperature area 30 in one independent area 33 is adjacent to the higher temperature area 31 in the other independent area 33. The advancing part 21 and the retracting part 22 of each U-shaped pipe 2 extend through the second partition plate 15 across each lower temperature are 30 and each higher temperature area 31.

According to the hygroscopic moisture separating and heating apparatus 40 of this embodiment, in addition to the effect obtained in the first embodiment, the following effect can be obtained. Namely, each U-shaped pipe is provided orthogonally to the longitudinal direction of the main body container 1, as such each advancing part 21 and each retracting part 22 can be shortened. Therefore, each pipe bundle 4 can be downsized, thus facilitating the transfer of the pipe bundles 4 to the site of installation. Additionally, since the internal space of the main body container 1 is divided into the plurality of independent areas 33, and the lower temperature area 30 of one independent area 33 is located adjacent the higher temperature area 31 of the other independent area 33, the temperature distribution in a horizontal plane of the main body container 1 can be securely leveled, thereby preventing significant thermal deformation of the main body container 1.

Third Embodiment

Next, a third embodiment of the present invention will be described with reference to FIGS. 7 and 8.

Figure 7:
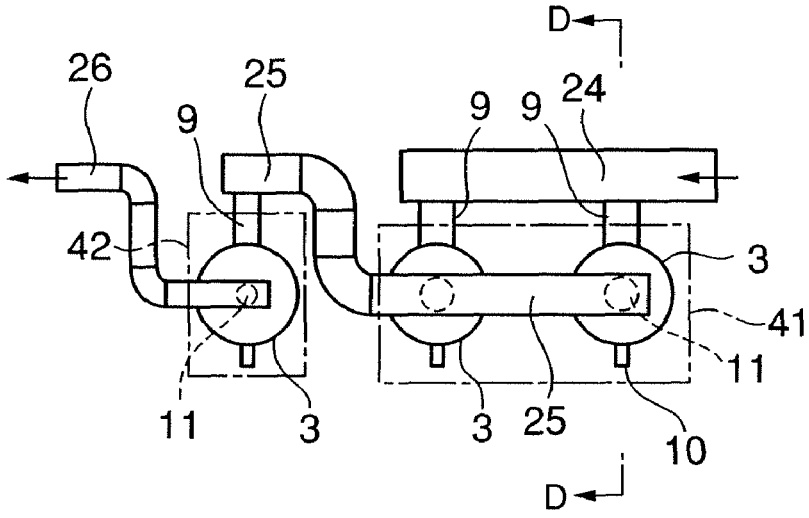
FIG. 7 is a lateral cross section showing a supply route for supplying heated steam to the U-shaped pipe of the hygroscopic moisture separating and heating apparatus of a third embodiment.
Figure 8:
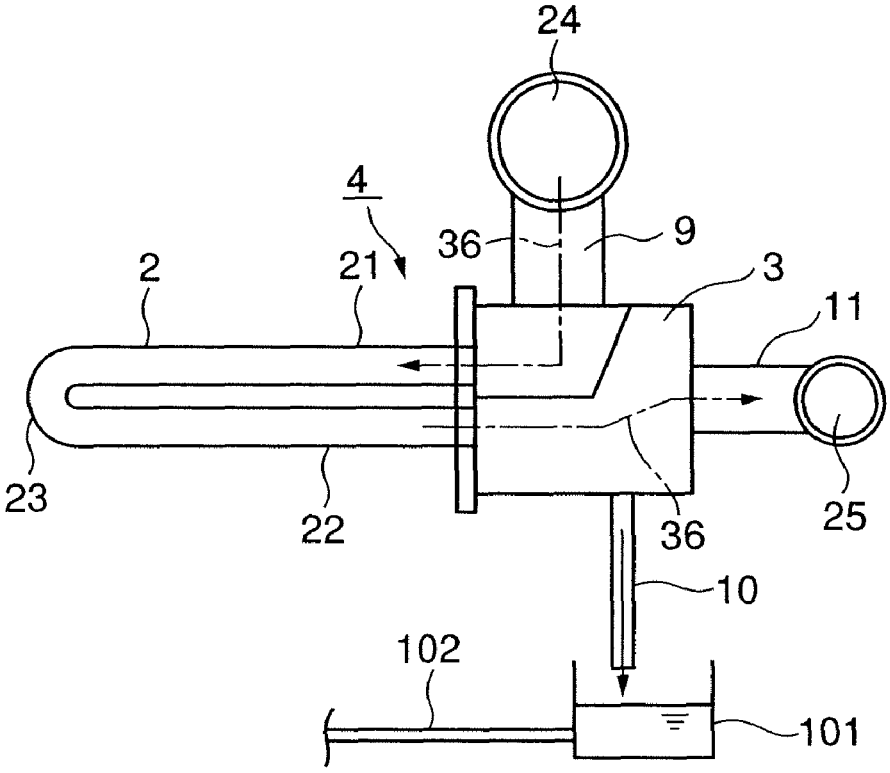
FIG. 8 is a longitudinal cross section of the supply route for the heated steam taken along line D-D of FIG. 7.
Figure 9:
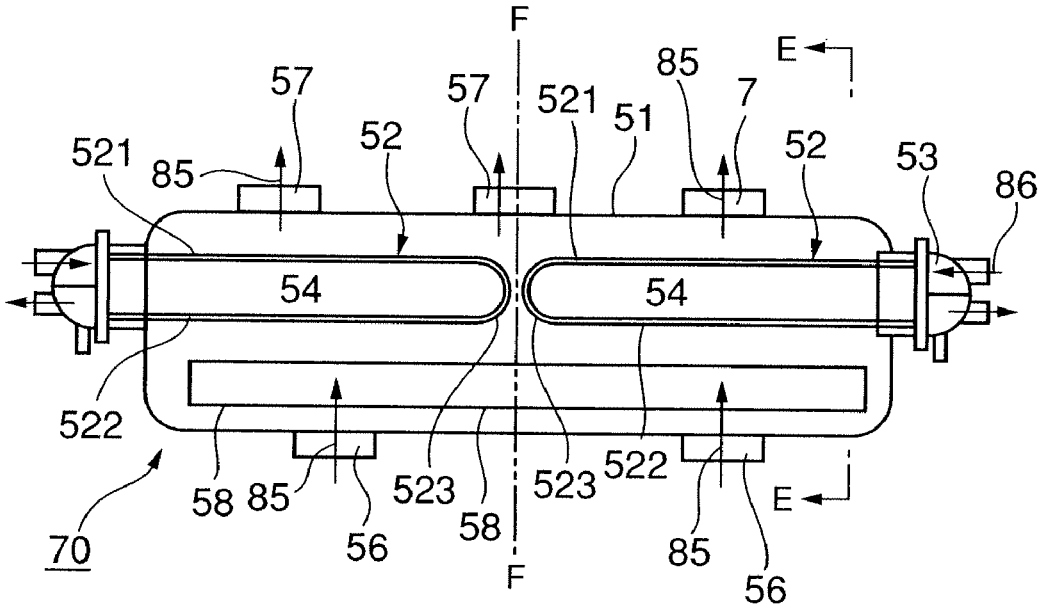
FIG. 9 PRIOR ART
FIG. 9 is a lateral cross section showing a construction of a conventional hygroscopic moisture separating and heating apparatus.
Figure 10:
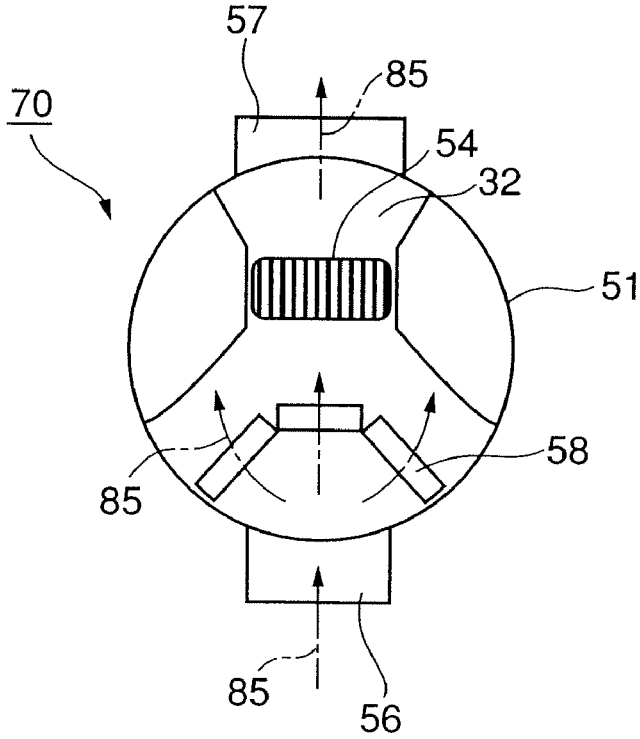
FIG. 10 PRIOR ART
FIG. 10 is a longitudinal cross section of the hygroscopic moisture separating and heating apparatus taken along line E-E of FIG. 9.

FIG. 7 is a lateral cross section showing a supply route for supplying heated steam 36 to each U-shaped pipe 2 of the hygroscopic moisture separating and heating apparatus 40 of the third embodiment, and FIG. 8 is a longitudinal cross section of the supply route for the heated steam 36 taken along line D-D of FIG. 7. In the third embodiment shown in FIGS. 7 and 8, like parts in the first embodiment and the second embodiment are respectively designated by like reference numerals, and will not be detailed below.

In the hygroscopic moisture separating and heating apparatus 40 of this embodiment, as shown in FIG. 7, the plurality of pipe bundles 4 are located in a plurality of independent groups connected in series with one another, and the pipe bundles 4 in each group are connected in parallel to one another, with the number of the pipe bundles 4 in each group being reduced as the heated steam 36 is flowed from the upstream to the downstream. The remaining construction, however, is substantially the same as the second embodiment shown in FIGS. 5 and 6.

As shown in FIG. 7, the plurality of pipe bundle 4 are divided into two bundles 4 constituting together an upstream group 41 and provided in parallel to each other and one pipe bundle 4 constituting a downstream group 42.

In FIG. 7, the heated steam 36 essentially consisting of extraction steam to be supplied from a high pressure turbine of an atomic power plant or of main steam to be supplied from a nuclear reactor is supplied into two headers 3 of the two pipe bundles 4 provided in parallel to each other and constituting the upstream group 41, via an upstream heated steam supply piping 24. Thereafter, the heated steam 36 discharged from the headers 3 of the two pipe bundles 4 of the upstream group 41 is supplied into the header 3 of the one pipe bundle 4 constituting the downstream group 42 via a downstream heated steam supply piping 25. Subsequently, the heated steam 36 discharged from the header 3 of the one pipe bundle 4 of the downstream group 42 is fed to the outside of the hygroscopic moisture separating and heating apparatus 40 via a heated steam exhaust piping 26.

The header 3 of each pipe bundle 4 includes a heated steam inlet 9 for receiving the heated steam 36 to be fed from the upstream side and a heated steam outlet 11 for discharging the heated steam 36 to the downstream side.

While, in FIG. 7, the upstream group 41 is composed of the two pipe bundles 4 and the downstream group 42 is composed of the one pipe bundle 4, the number of the pipe bundles 4 in each group is not limited to this aspect, provided that it is reduced as the heated steam 36 is flowed from the upstream to the downstream. For instance, the number of the pipe bundles 4 depends on the length of each U-shaped pipe 2 as well as on the flow speed of the heated steam 36 in the U-shaped pipe 2.

As shown in FIG. 8, a drain tank 101 is provided, which is for accumulating condensed drain generated due to the heated steam 36 cooled by the steam 35 to be heated, in each U-shaped pipe 2, and a drain pipe 10 adapted for feeding the condensed drain to the drain tank 101 is provided to the header 3 of each pipe bundle 4.

Now, the operation of the embodiment constructed as described above will be discussed.

The heated steam 36 fed into the hygroscopic moisture separating and heating apparatus 40 is first supplied into the two parallel pipe bundles 4 of the upstream group 41, simultaneously, via the upstream heated steam supply piping 24, so as to perform the heat exchange with the steam 35 to be heated in the main body container 1. Thereafter, the heated steam 36 discharged from the two pipe bundles 4 of the upstream group 41 is fed into the one pipe bundle 4 of the downstream group 42 via the downstream heated steam supply piping 25, so as to perform again the heat exchange with the steam 35 to be heated in the main body container 1. Finally, the heated steam 36 discharged from the one pipe bundle 4 of the downstream group 42 is fed to the outside of the hygroscopic moisture separating and heating apparatus 40 via the heated steam exhaust piping 26.

Meanwhile, the condensed drain is generated due to the heated steam 36 cooled by the steam 35 to be heated in the U-shaped pipe 2 of each pipe bundle 4. However, the so-generated condensed drain in each pipe bundle 4 is fed to each drain pipe 10 attached to each header 3 and collectively accumulated in the drain tank 101.

In this way, by limiting the number of pipe bundles 4 each adapted to feed the heated steam 36 at a time and discharging the condensed drain from the pipe bundles 4 of each group, in succession, by utilizing each drain pipe 10, the flow rate of the heated steam 36 in each U-shaped pipe 2 of the pipe bundles 4 can be increased, as well as overfilling of the condensed drain in each U-shaped pipe 2 of the pipe bundles 4 can be prevented.

Alternatively, a part of the condensed drain fed into the drain tank 101 from each header 3 of the pipe bundles 4 via each drain pipe 10 may be fed back through each higher temperature area 31 of the main body container 1, by utilizing a drain feed pipe 102 so as to cool the higher temperature area 31.

By employing the method as described above, the temperature difference between each lower temperature area 30 and each higher temperature area 31 can be lessened, as well as the temperature distribution in a horizontal plane of the main body container 1 can be securely leveled.

The invention claimed is:

1. A hygroscopic moisture separating and heating apparatus for separating a hygroscopic moisture from a steam to be heated and heating the steam to be heated, comprising:

a main body container having a cylindrical shape;

a partition plate provided, in the main body container, to define a space together with an inner circumferential face of the main body container and configured to divide the internal space of the main body container into a lower temperature area and a higher temperature area;

a steam inlet, which is provided to the lower temperature area of the main body container and through which steam to be heated is fed into the main body container; and a steam outlet, which is provided to the higher temperature area of the main body container and through which the steam to be heated is discharged from the main body container;

a hygroscopic moisture separator located in the lower temperature area of the main body container and adapted to separate hygroscopic moisture from the steam to be heated, which is fed into the lower temperature area via the steam inlet; and a plurality of U-shaped pipes provided in the main body container, each of the U-shaped pipes including an advancing part, a retracting part and a U-shaped part, wherein the U-shaped part connects the advancing part with the retracting part, such that heated steam for heating the steam to be heated is fed through the U-shaped pipe, wherein either of the advancing part and the retracting part of each of the U-shaped pipes extends through the partition plate across the lower temperature area and the higher temperature area, wherein each U-shaped pipe is attached to a header so that each U-shaped pipe and corresponding header constitute one of a plurality of pipe bundles, each header being provided outside the main body container and adapted to supply and discharge the heated steam, wherein the header of one of the pipe bundles is attached to the main body container, in a position opposed to the header of another one of the pipe bundles located adjacent to the one of the pipe bundles;

wherein the plurality of pipe bundles are located in a plurality of independent groups connected in series with one another, and the pipe bundles in each group are connected in parallel to one another, with the number of the pipe bundles in each group being reduced as the heated steam is flowed from the upstream to the downstream, wherein a drain tank is provided, which is adapted for accumulating condensed drain generated due to the heated steam cooled by the steam to be heated, in each U-shaped pipe, and wherein the drain tank is connected with the header of each pipe bundle via a drain pipe.

2. The hygroscopic moisture separating and heating apparatus, according to claim 1, wherein a part of the condensed drain fed to the drain tank via the drain pipe from each header is fed into the higher temperature area of the main body container through a drain feed pipe, so as to cool the higher temperature area.

3. A hygroscopic moisture separating and heating apparatus for separating a hygroscopic moisture from a steam to be heated and heating the steam to be heated, comprising:

a main body container having a cylindrical shape;

a first partition plate provided in the main body container orthogonally to the longitudinal direction of the main body container and configured to divide the internal space of the main body container into two or more mutually independent areas;

a second partition plate provided, in the main body container, to define a space together with an inner circumferential face of the main body container and configured to extend orthogonally to the first partition plate and divide each independent area of the main body container into a lower temperature area and a higher temperature area;

steam inlets each provided to each lower temperature area of the main body container, such that steam to be heated is fed into the main body container through the steam inlet;

steam outlets each provided to each higher temperature area of the main body container, such that the steam to be heated is discharged from the main body container through the steam outlet;

hygroscopic moisture separators each located in each lower temperature area of the main body container and adapted to separate hygroscopic moisture from the steam to be heated fed into the lower temperature area via each steam inlet; and U-shaped pipes each provided in each independent area of the main body container and including an advancing part, a retracting part and a U-shaped part connecting the advancing part with the retracting part, such that heated steam for heating the steam to be heated is fed through the U-shaped pipe, wherein the lower temperature area of one independent area is adjacent to the higher temperature area of the other independent area, and wherein either of the advancing part and the retracting part of each U-shaped pipe extends through the second partition plate across each lower temperature area and each higher temperature area.

4. The hygroscopic moisture separating and heating apparatus, according to claim 3, further comprising:

a venting pipe connected with an inlet portion of each U-shaped pipe and adapted for venting the heated steam; and a pressure control valve or fluid resistor provided to the venting pipe, wherein the pressure control valve or fluid resistor controls the venting flow rate of the heated steam fed into the venting pipe within the range of 0.5 to 1% of the total flow rate measured before the heated steam is vented.

5. The hygroscopic moisture separating and heating apparatus, according to claim 3, wherein each U-shaped pipe is attached to a header so that each U-shaped pipe and corresponding header constitute one of a plurality of pipe bundles, each header being provided outside the main body container and adapted to supply and discharge the heated steam, and wherein the header of one of the pipe bundles is attached to the main body container, in a position opposed to the header of another one of the other pipe bundles located adjacent the one pipe bundle.

6. The hygroscopic moisture separating and heating apparatus, according to claim 5, wherein the plurality of pipe bundles are located in a plurality of independent groups connected in series with one another, and the pipe bundles in each group are connected in parallel to one another, with the number of the pipe bundles in each group being reduced as the heated steam is flowed from the upstream to the downstream, wherein a drain tank is provided, which is adapted for accumulating condensed drain generated due to the heated steam cooled by the steam to be heated, in each U-shaped pipe, and wherein the drain tank is connected with the header of each pipe bundle via a drain pipe.

7. The hygroscopic moisture separating and heating apparatus, according to claim 6, wherein a part of the condensed drain fed to the drain tank via the drain pipe from each header is fed into each higher temperature area of the main body container through a drain feed pipe, so as to cool the higher temperature area.

8. The hygroscopic moisture separating and heating apparatus, according to claim 3, wherein the pipe bundles are prepared by assembling the plurality of U-shaped pipes and headers in advance in a factory, and then attached to the main body container on a site of installing the apparatus.

* * * * *